US007695096B2

(12) United States Patent
Komatsu et al.

(10) Patent No.: US 7,695,096 B2
(45) Date of Patent: Apr. 13, 2010

(54) INKJET PRINTER AND INKJET PRINTING METHOD

(75) Inventors: Hidehiko Komatsu, Nagano-ken (JP); Hitoshi Ota, Nagano-ken (JP); Daisuke Ishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 12/238,555

(22) Filed: Sep. 26, 2008

(65) Prior Publication Data

US 2009/0027470 A1 Jan. 29, 2009

Related U.S. Application Data

(62) Division of application No. 10/876,279, filed on Jun. 24, 2004, now Pat. No. 7,445,312.

(30) Foreign Application Priority Data

Jun. 26, 2003 (JP) ..... 2003-182967
Jun. 26, 2003 (JP) ..... 2003-182968
Jun. 26, 2003 (JP) ..... 2003-182969
Nov. 13, 2003 (JP) ..... 2003-384063

(51) Int. Cl.
*B41J 2/165* (2006.01)

(52) U.S. Cl. ..... 347/31; 347/22

(58) Field of Classification Search ..... 347/28, 347/29, 31, 32, 33
See application file for complete search history.

(56) References Cited

U.S. PATENT DOCUMENTS 5,980,018 A * 11/1999 Taylor et al. ..... 347/31
5,997,129 A 12/1999 Matsuhashi
6,239,817 B1 5/2001 Meyer
6,337,354 B1 1/2002 Katsumata et al.
6,699,423 B2 3/2004 Katsumata et al.
6,752,494 B2 6/2004 Matsui
6,820,962 B2 11/2004 Uchida
6,890,069 B2 5/2005 Matsui (Continued)

FOREIGN PATENT DOCUMENTS

JP 64-005852 1/1989

(Continued)

OTHER PUBLICATIONS

Patent Abstracts of Japan and JPO computer-generated English translation of JP 07-009712, dated Jan. 13, 1995.

(Continued)

*Primary Examiner*—Manish S Shah
(74) *Attorney, Agent, or Firm*—Ladas and Parry LLP

(57) ABSTRACT

The present invention provides an inkjet printer and an inkjet printing method, which enable an ink that overflowed to the outside from the edge of a printing medium to be fully absorbed by a platen. More specifically, the present invention provides an inkjet printer, including a platen, which absorbs a pigment ink that overflows to the outside of a printing medium when edgeless printing is carried out on the printing medium by using an ink that employs a pigment as a colorant, moving a printing head along a guide shaft, and ejecting the pigment ink from the printing head, and also an inkjet printing method, wherein the platen is impregnated with a humecant, a base, and the like.

8 Claims, 6 Drawing Sheets

U.S. PATENT DOCUMENTS

| | | | | |
|---|---|---|---|---|
| 2004/0126559 | A1 | 7/2004 | Katsumata et al. | |
| 2007/0046722 | A1 * | 3/2007 | Komatsu | 347/30 |

FOREIGN PATENT DOCUMENTS

| | | |
|---|---|---|
| JP | 07-009712 | 1/1995 |
| JP | 08-032448 | 2/1996 |
| JP | 08-169155 | 7/1996 |
| JP | 11-228894 | 8/1999 |
| JP | 11-286163 | 10/1999 |
| JP | 2000-212488 | 8/2000 |
| JP | 2001-105630 | 4/2001 |
| JP | 2001-328344 | 11/2001 |
| JP | 2001-354889 | 12/2001 |
| JP | 2002-326345 | 11/2002 |
| JP | 2003-025563 | 1/2003 |
| JP | 2003-080839 | 3/2003 |
| JP | 2003-096355 | 4/2003 |
| JP | 2003-170615 | 6/2003 |
| JP | 2003-191545 | 7/2003 |

OTHER PUBLICATIONS

Patent Abstracts of Japan and JPO computer-generated English translation of JP 08-169155, dated Jul. 2, 1996.

Patent Abstracts of Japan and JPO computer-generated English translation of JP 11-286163, dated Oct. 19, 1999.

Patent Abstracts of Japan and JPO computer-generated English translation of JP 2000-212488, dated Aug. 2, 2000.

Patent Abstracts of Japan and JPO computer-generated English translation of JP 2001-328344, dated Nov. 27, 2001.

Patent Abstracts of Japan and JPO computer-generated English translation of JP 2003-080839, dated Mar. 19, 2003.

Patent Abstracts of Japan and JPO computer-generated English translation of JP 2001-354889, dated Dec. 25, 2001.

Patent Abstracts of Japan and JPO computer-generated English translation of JP 2003-025563, dated Jan. 29, 2003.

Patent Abstracts of Japan and JPO computer-generated English translation of JP 2003-170615, dated Jun. 17, 2003.

Patent Abstracts of Japan and JPO computer-generated English translation of JP 2003-191545, dated Jul. 9, 2003.

Patent Abstracts of Japan publication No. 64-005852, dated Jan. 10, 1989.

Patent Abstracts of Japan and JPO computer-generated English translation of JP 08-032448, dated Feb. 2, 1996.

Patent Abstracts of Japan and JPO computer-generated English translation of JP 11-228894, dated Aug. 24, 1999.

Patent Abstracts of Japan and JPO computer-generated English translation of JP 2003-096355, dated Apr. 3, 2003.

* cited by examiner (A)

(B)

(C)

(A)

(B)

(C)

INKJET PRINTER AND INKJET PRINTING METHOD

CROSS-REFERENCE TO RELATED APPLICATION

This is a divisional of application Ser. No. 10/876,279 filed on Jun. 24, 2004 now U.S. Pat. No. 7,445,312 and claims the benefit thereof and incorporates the same by reference.

BACKGROUND

The present invention relates to an inkjet printer and inkjet printing method, and more particularly to an inkjet printer and inkjet printing method for conducting edgeless printing on a printing medium by moving a printing head along a guide shaft and ejecting a pigment ink from the printing head.

Inkjet printers capable of conducting printing with a zero margin on the front, rear, left, and right edges of a printing medium were disclosed (for example, Japanese Patent Applications Laid-open Nos. H7-9712 and 8-169155). With those openly disclosed inkjet printers, the printing operation is executed by so setting the scanning range of a printing head, which is placed on a carriage, that it reaches the positions outside the left and right edges of the printing medium.

When printing is carried out with such an inkjet printer, as shown in FIG. 5(A), a printing paper 100 serving as a printing medium is transported in the auxiliary scanning direction shown by arrow A and when the front edge 100A of the printing paper 100 reaches a position below the printing head 101, the carriage (not shown in the figure) moves reciprocally along the main scanning direction shown by arrow B, an ink 102 is ejected from the printing head 101, and printing on the printing paper 100 is started.

At this time, in order to conduct printing so that the margin at the front edge 100A of the printing paper 100 is zero, the ink 102 is caused to overflow to the outside from the front edge 100A of the printing paper 100.

If a state shown in FIG. 5(B) is then assumed by transporting the printing paper 100 from the above-described position in the auxiliary scanning direction shown by arrow A, then in order to conduct printing so that the margin at the side edge 100B of the printing paper 100 is zero, the ink 102 is caused to overflow to the outside from the side edge 100B of the printing paper 100 by appropriately adjusting the reciprocal movement distance of the carriage in the main scanning direction shown by arrow B.

Furthermore, if a state shown in FIG. 5(C) is then assumed by transporting the printing paper 100 from the above-described position in the auxiliary scanning direction shown by arrow A, then in order to conduct printing so that the margin at the rear edge 100C of the printing paper 100 is zero, the ink 102 is caused to overflow to the outside from the rear edge 100C of the printing paper 100.

Here, the pigment ink 102 that overflowed from the front edge 100A, side edge 100B, or rear edge 100C of the printing paper 100 is absorbed by the platen 104 shown in FIG. 6. For example, Japanese Patent Application Laid-open No. H7-9712 discloses using a porous ceramic or the like as an ink absorbing body. When a pigment ink was used to conduct edgeless printing with such a configuration, in particular, under utilization conditions with increased room temperature, for example, in a warm season, moisture present in the pigment ink 102 that was ejected onto the platen rapidly evaporated and pigment precipitated.

As a result, as shown in FIG. 7, the pigment ink 102 sometimes could not be sufficiently absorbed by the platen 104 and, as shown in FIG. 8, the ink (pigment) 102 sometimes formed a deposit (sometimes referred to hereinbelow as "pile 105") on the surface of the platen 104.

If such a pile 105 appears on the source of the platen 104, when printing is conducted on the next printing paper 100, the end surface of the printing paper 100 is brought into contact with the pile 105 and the end surface of the printing paper 100 is contaminated.

With the foregoing in view, it is an object of the present invention to provide an inkjet printer and inkjet printing method using a pigment ink, wherein the ink that overflowed to the outside from the edges of the printing medium can be fully absorbed by a platen.

SUMMARY

In order to attain the above-described object, the inkjet printer of the present invention (referred to hereinbelow as "the first invention") or the inkjet printing method of the present invention (referred to hereinbelow as "the second invention") comprises a step of causing a platen to absorb a pigment ink that overflows to the outside of a printing medium when edgeless printing is carried out on the printing medium by using an ink that employs a pigment as a colorant, moving a printing head along a guide shaft, and ejecting the pigment ink from the printing head, wherein the platen is impregnated with at least a humecant and a base.

Using the humecant mentioned hereinabove efficiently prevents the ink from drying, can inhibit the solidification of the ink cause by the increase in concentration of solid components even when moisture has evaporated from the pigment ink ejected onto the platen, and the platen can be rapidly infiltrated with the ink. Furthermore, the base acts as a dispersing base for causing the pigment to disperse in the ink and inhibits the coagulation of the pigment when pigment dispersion was destabilized by moisture evaporation.

In particular, in recent inkjet printers, ink droplets which are to be ejected from an inkjet head have been reduced in size to several picoliters in order to increase image quality. In such cases, the ink droplets that were discharged onto the platen dry very easily and solidify and deposit on the platen prior to being infiltrated in the platen. Therefore, impregnating the platen in advance with the humecant and base, which inhibit the solidification and coagulation caused by drying, can prevent the deposition of pigment ink on the platen even in the recently developed printers using ultrafine ink droplets.

Further in the preferred embodiment, the humecant is a polyol with a vapor pressure of 0.01 mm Hg or less at a temperature of 20° C. The polyols with a vapor pressure of 0.01 mm Hg or less at a temperature of 20° C. are very difficult to evaporate, and the pigment ink present on the platen can be absorbed, without solidification, in the platen even when room temperature has risen, for example, in a warm season.

Furthermore, in the preferred embodiment, the aforementioned base is an alkanolamine, an inorganic base, or an imidazole.

In the preferred embodiment of the inkjet printer or inkjet printing method in accordance with the present invention, an preservative component is preferably additionally impregnated in the platen.

For example, when a sugar is used as the aforementioned humecant, the sugar serving as a nutrient can produce mold or fungi inside the platen. Therefore, it is preferred that a preservative be used in addition to the humecant and base inside the platen to prevent completely the appearance of such mold and fungi.

Further, the present invention also provides an inkjet printer comprising a platen, which absorbs a pigment ink that overflows to the outside of a printing medium when edgeless printing is carried out on the printing medium by using an ink that employs a pigment as a colorant, moving a printing head along a guide shaft, and ejecting the pigment ink from the printing head, wherein the platen comprises a compound of at least one kind selected from a group including ethers, acetates, cellosolves, carbitols, acetylene glycols, and acetylene alcohols as a penetrating agent (referred to hereinbelow as "the third invention").

The penetrating agent as referred to herein acts to decrease the surface tension of the ink. Therefore, in the inkjet printers of such a configuration, impregnating the platen with such a penetrating agent, further facilitates the absorption of the pigment ink by the platen.

Further, such penetrating agents have affinity to pigments and also relax the cohesion of pigments. Therefore, the precipitation of the pigment can be inhibited and the pigment can be fully absorbed by the platen even when moisture evaporates from the pigment ink and the pigment concentration in the ink increases, in particular, when the room temperature rises, for example, in a warm season.

Further, in the preferred embodiment of the inkjet printer in accordance with the present invention, the penetrating agent comprises a compound of at least one kind selected from a group including ethers, acetates, cellosolves, and carbitols and a compound of at least one kind selected from a group including acetylene glycols and acetylene alcohols.

In the inkjet printer of such a configuration, introducing the above-described penetrating agent into the platen results in efficient absorption by the platen of the pigment ink that overflowed to the outside of the printing medium. As a result, the precipitation of the pigment can be inhibited and the pigment can be fully absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

Further, in the preferred embodiment of the inkjet printer in accordance with the present invention, the platen further comprises a polyol with a vapor pressure of 0.1 mm Hg or less at a temperature of 20° C.

In the inkjet printer of such a configuration, impregnating the platen with the above-described penetrating agent and a specific polyol results in efficient absorption by the platen of the pigment ink that overflowed to the outside of the printing medium. The polyol referred to herein, when used together with the above-mentioned penetrating agent, further inhibits the drying of the ink. As a result, the precipitation of the pigment can be inhibited and the pigment can be fully and efficiently absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

The inkjet printing method in accordance with the present invention comprises a step of causing a platen to absorb a pigment ink that overflows to the outside of a printing medium when edgeless printing is carried out on the printing medium by using an ink that employs a pigment as a colorant, moving a printing head along a guide shaft, and ejecting the pigment ink from the printing head, wherein the platen is impregnated with a compound of at least one kind selected from a group including ethers, acetates, cellosolves, carbitols, acetylene glycols, and acetylene alcohols as a penetrating agent (referred to hereinbelow as "the fourth invention").

With the inkjet printing method of such a configuration, impregnating the platen in advance with the above-described penetrating agent results in efficient absorption by the platen of the pigment ink that overflowed to the outside of the printing medium. As a result, the precipitation of the pigment can be inhibited and the pigment can be fully absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

In the preferred embodiment of the inkjet printing method in accordance with the present invention, a compound of at least one kind selected from a group including ethers, acetates, cellosolves, and carbitols and a compound of at least one kind selected from a group including acetylene glycols and acetylene alcohols are used as a penetrating agent.

In another preferred embodiment of the inkjet printing method in accordance with the present invention, the platen is further impregnated with a polyol with a vapor pressure of 0.1 mm Hg or less at a temperature of 20° C.

The inkjet printer in accordance with the present invention comprises a platen, which absorbs a pigment ink that overflows to the outside of a printing medium when edgeless printing is carried out on the printing medium by using an ink that employs a pigment as a colorant, moving a printing head along a guide shaft, and ejecting the pigment ink from the printing head, wherein the platen comprises a solid humecant with a melting point of 20° C. or higher and a solubility in water of 5 wt. % or higher at a temperature of 20° C. (referred to hereinbelow as "the fifth invention").

The solid humecant acts to increase permeability with respect to the ink. Therefore, in the inkjet printer of such a configuration, if the platen is impregnated with such a solid humecant, the pigment ink is easier absorbed by the platen.

Further, such solid humecant have affinity to pigments and also relax the cohesion of pigments. Therefore, the precipitation of the pigment can be inhibited and the pigment can be fully and efficiently absorbed by the platen even when moisture evaporates from the pigment ink and the pigment concentration in the ink increases, in particular, when the room temperature rises, for example, in a warm season.

Further, in the preferred embodiment of the inkjet printer in accordance with the present invention, the solid humecant is of at least one kind selected from a group including alcohols, esters, nitrogen compounds, and sugars.

In the inkjet printer of such a configuration, impregnating the platen with the above-described solid humecant results in efficient absorption by the platen of the pigment ink that overflowed to the outside of the printing medium. As a result, the precipitation of the pigment can be inhibited and the pigment can be fully absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

Further, in the preferred embodiment of the inkjet printer in accordance with the present invention, the platen further comprises a polyol with a vapor pressure of 0.1 mm Hg or less at a temperature of 20° C.

In the inkjet printer of such a configuration, impregnating the platen with the above-described solid humecant and a specific polyol results in efficient absorption by the platen of the pigment ink that overflowed to the outside of the printing medium. The polyol referred to herein, when used together with the above-mentioned solid humecant, further inhibits the drying of the ink. As a result, the precipitation of the pigment can be inhibited and the pigment can be fully and efficiently absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

On the other hand, the inkjet printing method in accordance with the present invention comprises a step of causing a platen to absorb a pigment ink that overflows to the outside of a printing medium when edgeless printing is carried out on the printing medium by using an ink that employs a pigment as a colorant, moving a printing head along a guide shaft, and ejecting the pigment ink from the printing head, wherein the platen is impregnated with a solid humecant with a melting point of 20° C. or higher and a solubility in water of 5 wt. % or higher at a temperature of 20° C. (referred to hereinbelow as "the sixth invention").

With the inkjet printing method of such a configuration, impregnating the platen in advance with the above-described solid humecant results in efficient absorption by the platen of the pigment ink that overflowed to the outside of the printing medium. As a result, the precipitation of the pigment can be inhibited and the pigment can be fully and efficiently absorbed by the platen even when moisture evaporates from the pigment ink ejected onto the platen and the pigment concentration in the ink increases, in particular, when the room temperature rises, for example, in a warm season.

Therefore, piling of the dried ink on the surface of the platen can be prevented. As a result, the printing medium that is employed thereafter is prevented from being brought into contact with the piled-up ink and contamination of the printing medium can be prevented.

In the preferred embodiment of the inkjet printing method in accordance with the present invention, a compound of at least one kind selected from alcohols, esters, nitrogen compounds, and sugars is sued as the solid humecant.

In another preferred embodiment of the inkjet printing method in accordance with the present invention, the platen is further impregnated with a polyol with a vapor pressure of 0.1 mm Hg or less at a temperature of 20° C.

The inkjet printer in accordance with the present invention comprises a platen, which absorbs an ink that overflows to the outside of the edge of a printing medium when edgeless printing is carried out on the printing medium by moving a printing head along a guide shaft and ejecting the ink from the printing head, wherein the platen comprises an oily solvent (referred to hereinbelow as "the seventh invention").

In the preferred embodiment of the inkjet printer in accordance with the present invention, the oily solvent has a melting point of 10° C. or lower and a boiling point of 150° C. or higher.

Further, the oily solvent is a compound of at least one kind selected from a group including hydrocarbons, monools or polyols.

The inkjet printing method in accordance with the present invention comprises a step of causing a platen to absorb an ink that overflows to the outside of the edge of a printing medium when edgeless printing is carried out on the printing medium by moving a printing head along a guide shaft and ejecting the ink from the printing head, wherein the platen is impregnated with an oily solvent (referred to hereinbelow as "the eighth invention").

In the preferred embodiment of the inkjet printing method in accordance with the present invention, an oily solvent with a melting point of 10° C. or lower and a boiling point of 150° C. or higher is used as the oily solvent.

Further, the oily solvent is a compound of at least one kind selected from a group including hydrocarbons, monools or polyols.

DETAILED DESCRIPTION

First Invention and Second Invention

Figure 5:
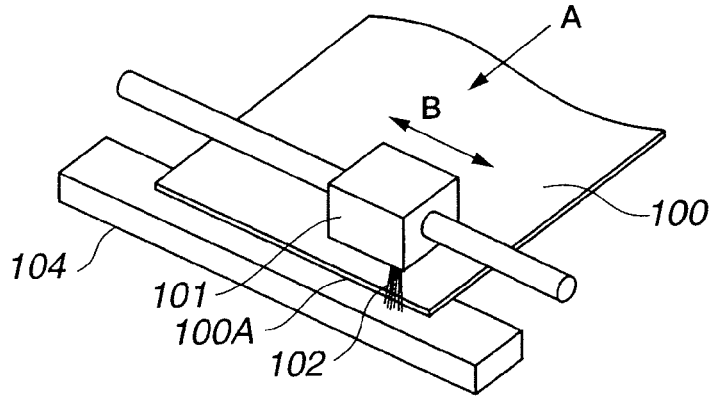
FIG. 5 is an explanatory figure illustrating the conventional inkjet printing method.
Figure 5:
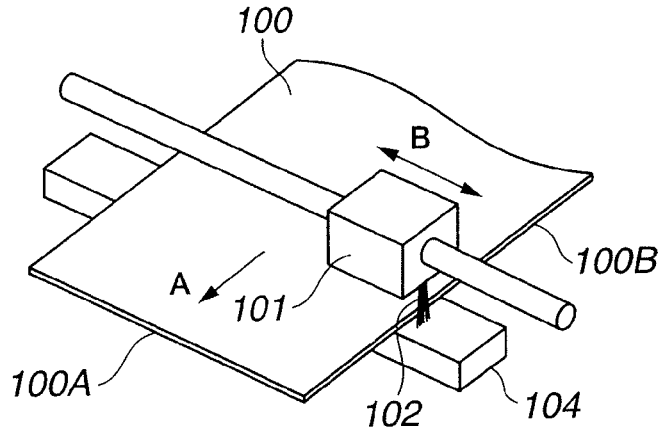
Figure 5:
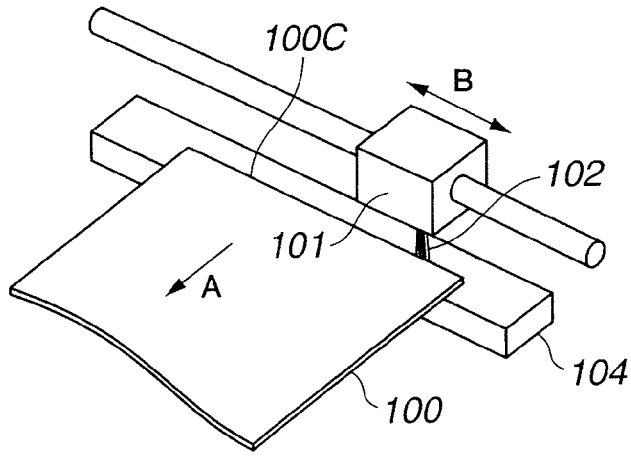
Figure 6:
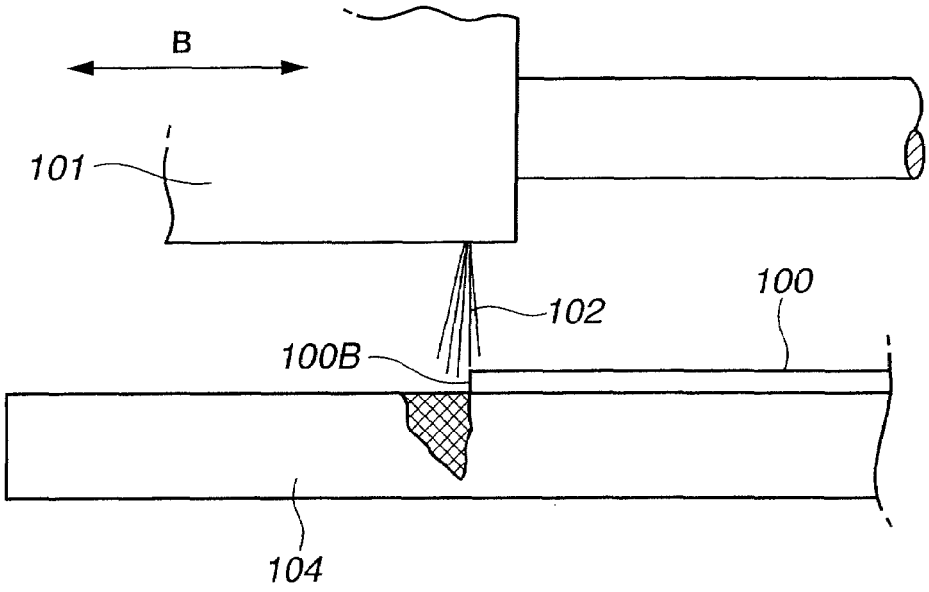
FIG. 6 is an explanatory figure illustrating the conventional inkjet printing method.
Figure 7:
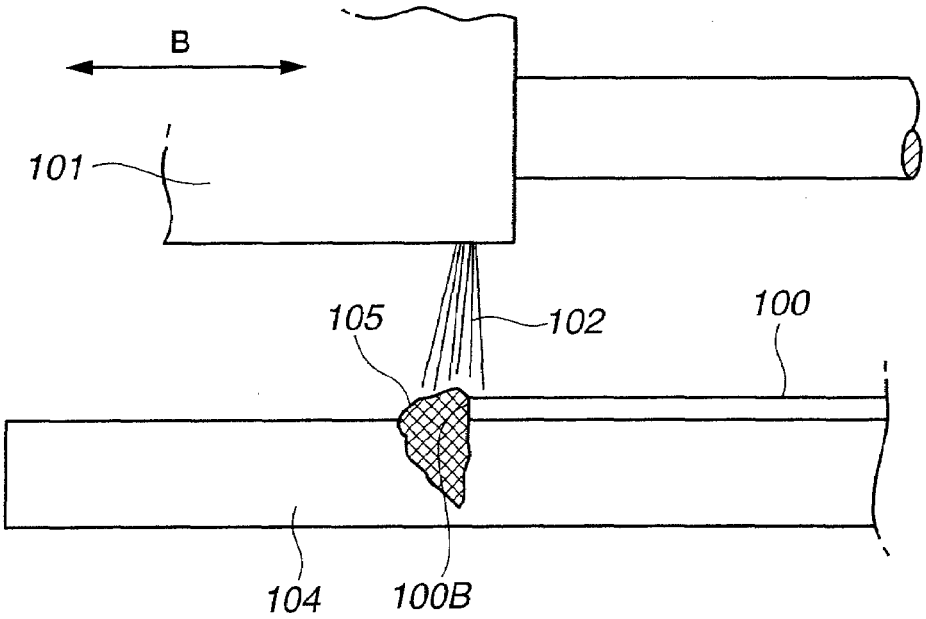
FIG. 7 is an explanatory figure illustrating the conventional inkjet printing method.
Figure 8:
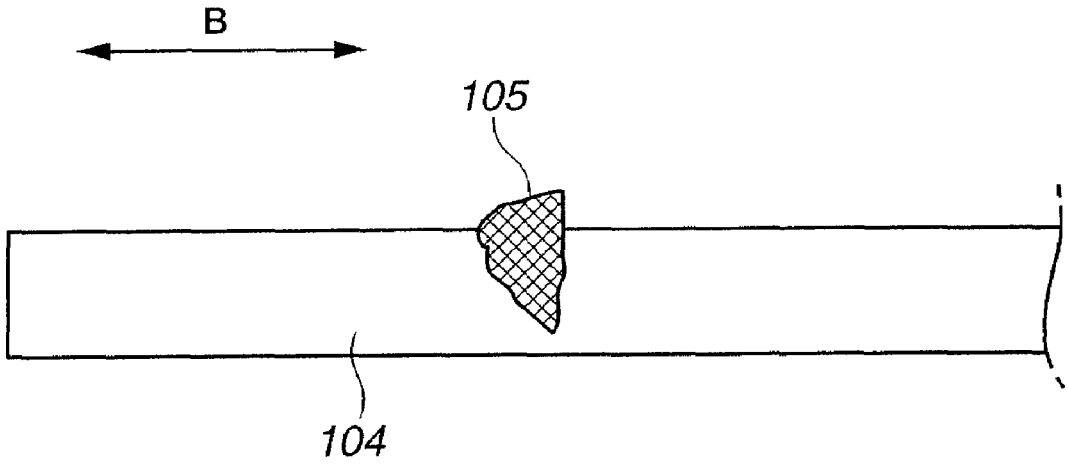
FIG. 8 is an explanatory figure illustrating the conventional inkjet printing method.

The preferred embodiments relating to the first invention and second invention will be described hereinbelow in detail based on the appended figures. In the embodiments explained hereinbelow, the components that have already been described with reference to FIGS. 5, 7, and 8 are assigned with identical or equivalent reference symbols and the explanation thereof will be simplified or omitted.

Figure 1:
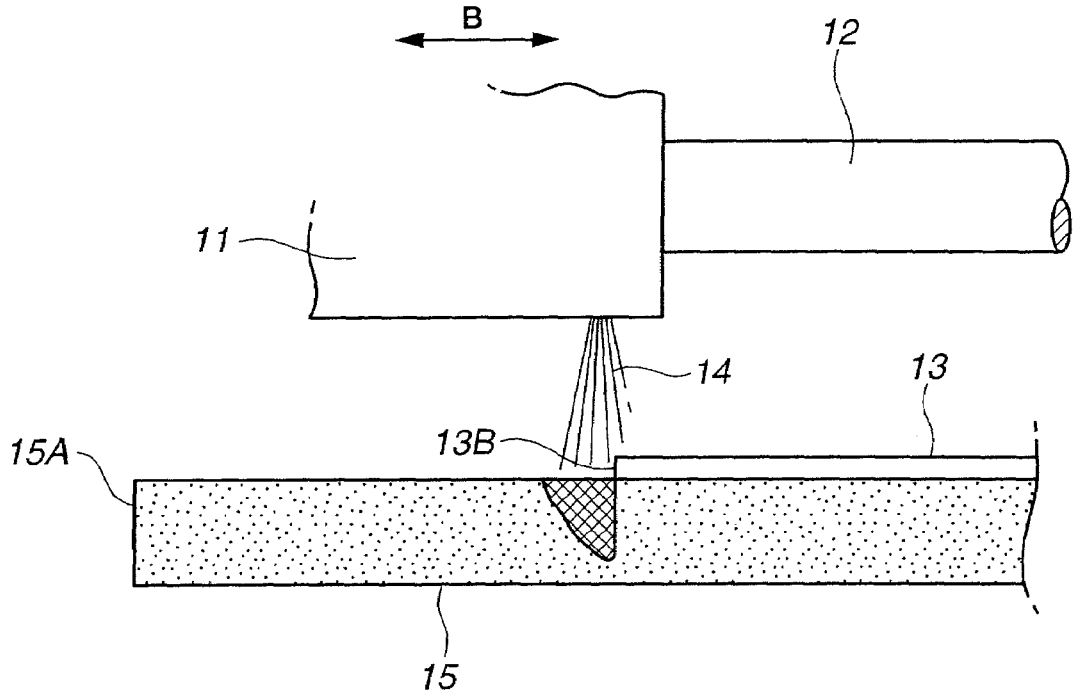
FIG. 1 is a schematic figure illustrating the inkjet printer of the present invention.
Figure 2:
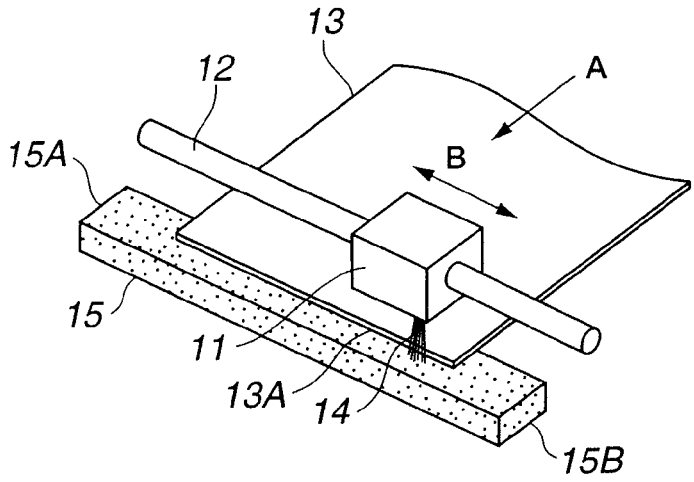
FIG. 2 is an explanatory figure illustrating the inkjet printing method of the present invention.
Figure 2:
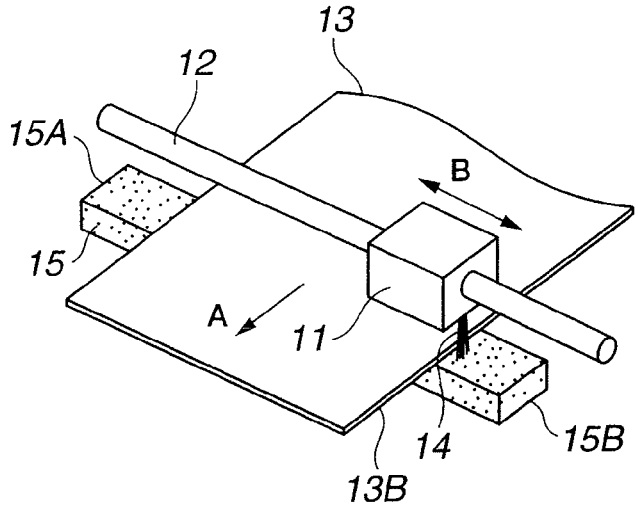
Figure 2:
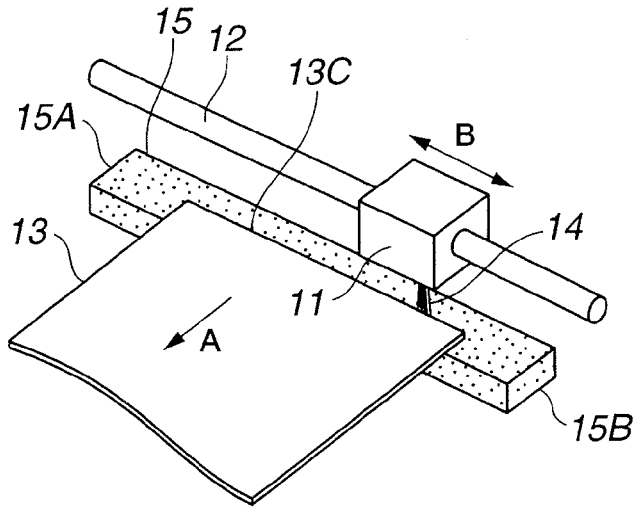

As shown in FIG. 1 and FIG. 2, an ink-jet printer using the pigment ink in accordance with the present invention is so constructed that when a printing head 11 moves in the main scanning direction shown by arrow B along a guide shaft 12 and edgeless printing on a printing paper (printing medium) 13 is conducted by ejecting the ink from the printing head 11, the ink 14 that overflowed to the outside of the printing paper 13 is absorbed by a platen 15.

A carriage (not shown in the figures) is provided at the printing head, and this carriage is movably supported by the guide shaft 12. As a result, the printing head 11 can be scanned in the main scanning direction shown by arrow B along the guide shaft 12.

An ink prepared by using a pigment as a colorant is used.

A black ink cartridge 17 or color ink cartridge 18 is detachably installed in the printing head 11. The distal end of the black ink cartridge 17 is connected to a nozzle 11A of the printing head 11.

Further, a cyan cartridge 18A, a magenta cartridge 18B, and a yellow cartridge 18C are provided in the color ink cartridge 18, and distal ends of each cartridge 18A, 18B, and 18C are connected to the nozzles 11B, 11C, and 11D of the printing head 11.

A platen is disposed parallel to the guide shaft 12 below the guide shaft 12. The platen 15 is made, for example, from a foamable resin, but other materials such as cotton, sponge, and urethane foam can be also used.

The platen 15 is impregnated with a humecant, a base, a preservative, or the like over the entire region from one end portion 15A to the other end portion 15B.

The humecant is preferably an agent which has a high moisture retaining capability and hygroscopicity and is not evaporated easily. An especially preferred example of the humecant is a polyol with a vapor pressure of 0.01 mm Hg or less at a temperature of 20° C.

Specific preferred examples include polyhydric alcohols such as glycerin, diethylene glycol, triethylene glycol, tetraethylene glycol, 1,5-pentanediol, 1,6-hexanediol, 1,2,6-hexanetriol, propylene glycol, dipropylene glycol, tripropylene glycol, and polyethylene glycol, and sugars such as glucose, mannose, fructose, ribose, xylose, arabinose, lactose, galactose, maltose, cellobiose, sucrose, trehalose, maltotriose, and maltitol.

Examples of the preferred bases include alkanolamines, inorganic bases, and imidazoles.

Specific examples of alkanolamines include monoethanolamine, diethanolamine, triethanolamine, or monopropanolamine, dipropanolamine, and tripropanolamine. For example because triethanolamine has a vapor pressure of 0.01 mm Hg at a temperature of 20° C., it combines properties of the humecant and base in accordance with the present invention.

Specific examples of inorganic bases include lithium hydroxide, sodium hydroxide, and potassium hydroxide.

Specific examples of imidazoles include imidazole, N-methyl imidazole, 2-methyl imidazole, 2-hydroxyimidazole, 4-hydroxyimidazole, and 5-hydroxyimidazole.

Specific examples of preservatives include dichlorophene, hexachlorophene, 1, 2-benzothiazolin-3-one, 3,4-isothiazolin-3-one, or 4,4-dimethyl oxazolidine, alkyl isothiazolone, chloroalkyl isothiazolone, benzoisothiazolone, bromonitroalcohol, and chloroxylenol.

The above-described humecant, base, and preservative may be used individually or in a liquid mixture thereof. The mixing ratio may be appropriately determined according to operability in impregnating into the platen 15 or the type of the pigment ink that will be used. No specific limitation is placed on this ratio, provided the target effect can be ensured. For example, the base has to be added at least in an amount sufficient to obtain the pH value of the entire liquid mixture of 7 or higher. Otherwise the amount thereof can be appropriately determined according to the type of the pigment ink that will be used. No limitation is placed on the amount of preservative, provided that a sufficient anticorrosive effect is obtained.

With the inkjet printer 10 using the pigment ink, the printing head 11 can be scanned along the guide shaft 12 by moving the carriage in the main scanning direction shown by arrow B along the guide shaft 12. At the same time, when the printing paper 13 is fed in the auxiliary scanning direction (arrow A), which is perpendicular to the scanning direction of the printing head 11, then printing on the printing paper 13 can be conducted by ejecting the ink via the nozzles 11A to 11D from the cartridges 17 and 18A to 18C.

The inkjet printing method employing the inkjet printer 10 using the pigment ink will be described hereinbelow based on FIG. 2 and FIG. 4.

When printing is conducted with the inkjet printer 10 using the pigment ink, as shown in FIG. 2(A), once the distal end 13A of the printing paper 13 which is transported in the auxiliary scanning direction shown by arrow A has reached a position below the printing head 11, the carriage moves reciprocally along the main scanning direction shown by arrow B, the pigment ink 14 is ejected from the printing head 11, and printing on the printing paper 13 is started. At this time, in order to conduct printing so that the margin at the front edge 13A of the printing paper 13 is zero, the pigment ink 14 is caused to overflow to the outside from the front edge 13A of the printing paper 13.

If a state shown in FIG. 2(B) is then assumed by transporting the printing paper 13 from the above-described position in the auxiliary scanning direction shown by arrow A, then in order to conduct printing so that the margin at the side edge 13B of the printing paper 13 is zero, the pigment ink 14 is caused to overflow to the outside from the side edge 13B of the printing paper 13 by appropriately adjusting the reciprocal movement distance of the carriage in the main scanning direction shown by arrow B.

Figure 3:
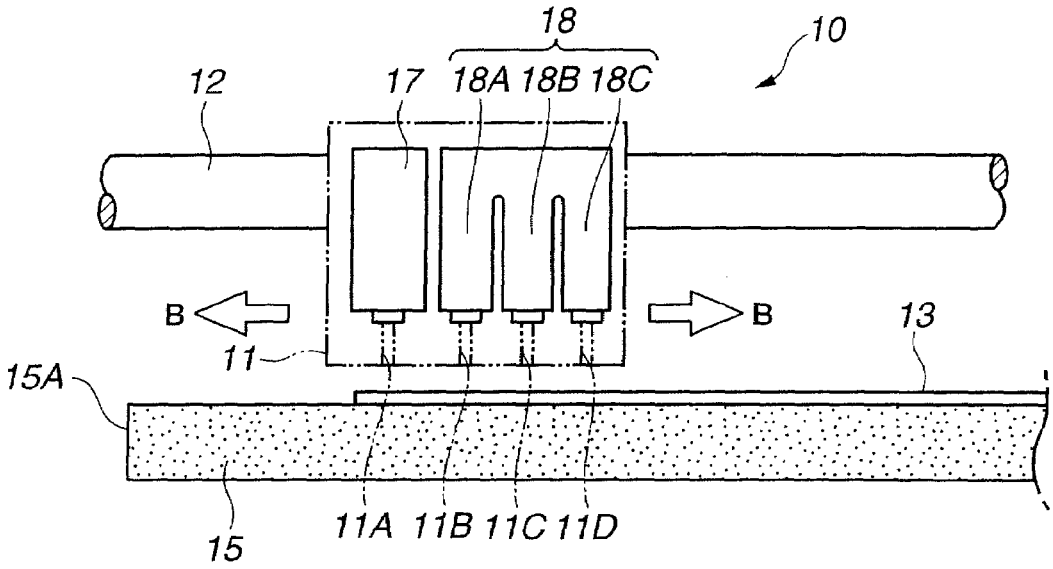
FIG. 3 is an explanatory figure illustrating the inkjet printing method of the present invention.

Furthermore, if a state shown in FIG. 2(C) is then assumed by transporting the printing paper 13 from the above-described position in the auxiliary scanning direction shown by arrow A, then in order to conduct printing so that the margin at the rear edge 13C of the printing paper 13 is zero, the pigment ink 14 is caused to overflow to the outside from the rear edge 13C of the printing paper 13 (see FIG. 3).

Here, the pigment ink 14 that overflowed from the front edge 13A, side edge 13B, or rear edge 13C of the printing paper 13 is absorbed by the platen 15 shown in FIG. 3. The platen 15 can be impregnated with the above-described humecant, base and/or preservative over the entire region from one end portion 15A to the other end portion 15B. Furthermore, it can be also impregnated with at least one compound selected from a group including ethers, acetates, cellosolves, carbitols, acetylene glycols, and acetylene alcohols as a penetrating agent.

Figure 4:
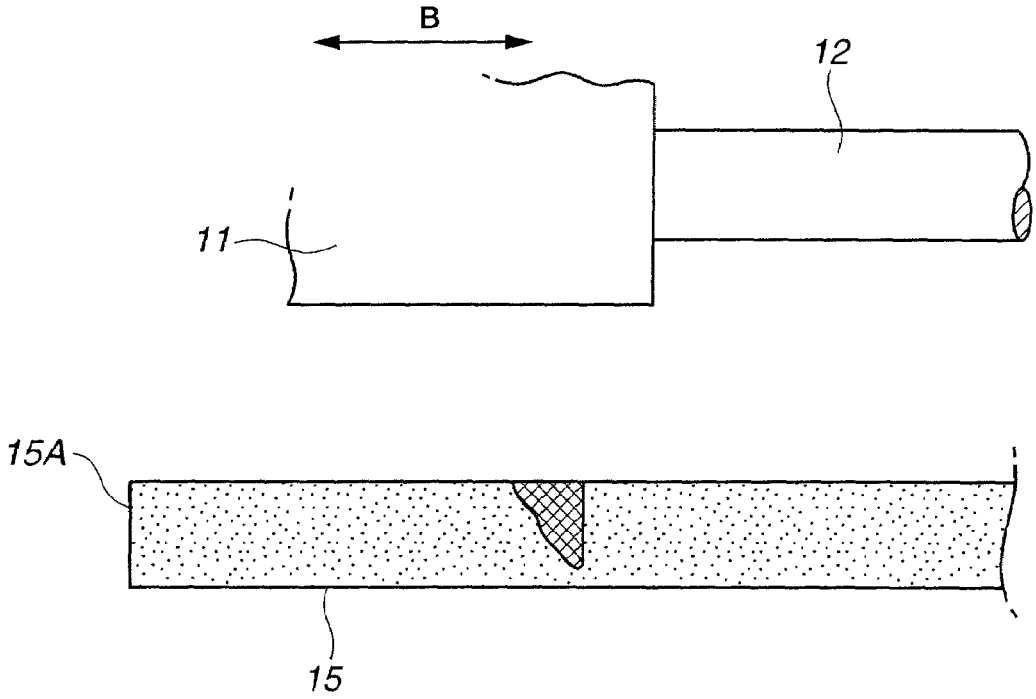
FIG. 4 is an explanatory figure illustrating the inkjet printing method of the present invention.

As a result, as shown in FIG. 4, the pigment ink 14 that overflowed from the front edge 13A, side edge 13B, or rear edge 13C of the printing paper 13 can be efficiently absorbed by the platen 15. As a result, when the inkjet printer 10 using a pigment ink is employed under conditions such that the room temperature is increased, in particular, in a warm season, even if moisture evaporates from the pigment ink that was ejected onto a platen and the concentration of the pigment increases, the precipitation of the pigment can be inhibited and the pigment ink 14 can be fully absorbed by the platen 15.

Therefore, piling of the ink (pigment) on the surface of the platen 15, which was typical with the conventional technology, can be prevented. As a result, when printing is conducted on the printing paper 13, contamination of the end surface of the printing paper 13 due to contact of this end surface of the printing paper with the piled-up ink is prevented.

Further, a penetrating agent is impregnated into the platen 15 over the entire region from one end portion 15A to the other end portion 15B. Therefore, the ink that was absorbed by the platen 15 from the front edge 13A, side edge 13B, and rear edge 13C of the printing paper 13 can be caused to permeate over the entire region from one end portion 15A to the other end portion 15B of the platen 15. Therefore, the platen 15 can absorb a large quantity of pigment ink and the replacement cycle of the platen 15 can be extended.

In the above-described embodiments, the explanation was conducted with reference to the printing paper 13 as a printing medium, but such a selection is not limiting, and the present invention is also applicable to other printing media.

Furthermore, the present invention is not limited to the above-described embodiments and appropriate modifications and changes can be made. Further, no limitation is placed on material, shape, dimensions, form, number, arrangement, and thickness of the printing head, guide shaft, and platen described in the aforementioned embodiments, provided that the object of the present invention can be attained.

Third Invention and Fourth Invention

The embodiments relating to the third invention and fourth invention will be described hereinbelow in greater detail based on the appended figures. The third invention and fourth invention are similar to the above-described first invention and second invention, except for the components which are different from those of the first invention and second invention. Therefore, features that were explained in relation to the above-described first invention and second invention can be appropriately employed with respect to those features of the third invention and fourth invention that are not described in detail.

The platen 15 of the embodiment relating to the third invention and fourth invention is impregnated with a penetrating agent over the entire region from one end portion 15A to the other end portion 15B thereof. A compound of at least one kind selected from a group including ethers, acetates, cellosolves, carbitols, acetylene glycols, and acetylene alcohols is suitable as the penetrating agent.

Ethers, acetates, cellosolves, carbitols, acetylene glycols, and acetylene alcohols, which represent penetrating agents, may be impregnated individually into the platen 15, or two or more types thereof may be mixed and impregnated. It is, however, preferred that the platen 15 be impregnated with a mixture containing a compound of at least one kind selected from a group including ethers, acetates, cellosolves, and carbitols and a compound of at least one kind selected from a group including acetylene glycols and acetylene alcohols.

Specific examples of ethers as the aforementioned penetrating agents include ethylene glycol dimethyl ether, diethylene glycol dimethyl ether, 2-(methoxymethoxy)ethanol, ethylene glycol isopropyl ether, furfuryl alcohol, tetrahydrofurfuryl alcohol, triethylene glycol monomethyl ether, triethylene glycol monoethyl ether, triethylene glycol monobutyl ether, propylene glycol monomethyl ether, propylene glycol monoethyl ether, dipropylene glycol monomethyl ether, dipropylene glycol monoethyl ether, and tripropylene glycol monomethyl ether.

Specific examples of cellosolves include ethylene glycol diethyl ether, ethylene glycol dibutyl ether, ethylene glycol monomethyl ether, ethylene glycol monoethyl ether, ethylene glycol monobutyl ether, ethylene glycol monoisoamyl ether, ethylene glycol monohexyl ether, ethylene glycol monophenyl ether, and ethylene glycol monobenzyl ether.

Furthermore, specific examples of acetates include ethylene glycol monomethyl ether acetate, ethylene glycol monobutyl ether acetate, and ethylene glycol monophenyl ether acetate.

Specific examples of carbitols include diethylene glycol diethyl ether, diethylene glycol dibutyl ether, diethylene glycol monomethyl ether, diethylene glycol monoethyl ether, diethylene glycol monobutyl ether, diethylene glycol monoethyl ether acetate, and diethylene glycol monobutyl ether acetate.

Examples of acetylene glycols include compounds represented by the following Formula (1).

[Formula 1]

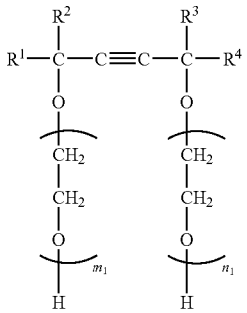

(1)

(in this formula, R1, R2, R3, and R4 independently from each other represent alkyl groups; $m_1+n_1$ is from 0 to 30).

Examples of acetylene alcohols include compounds represented by the following Formula (2).

[Formula 2]

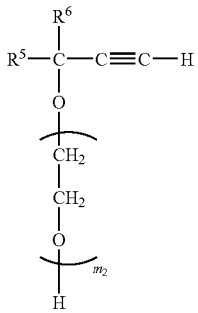

(2)

(in this formula, R5, R6 independently from each other represent alkyl groups; $m_2$ is from 0 to 30).

Commercial products can be used as the acetylene glycols represented by Formula (1) above. Specific examples thereof include Surfynol 104, Surfynol 104E, Surfynol 104H, Surfynol 104A, Surfynol 104BC, Surfynol 104DPM, Surfynol 104PA, Surfynol 104S, Surfynol 420, Surfynol 440, Surfynol 465, Surfynol 485, Surfynol SE, Surfynol SE-F, Surfynol 504, Surfynol DF110D, Surfynol DF37, Surfynol CT111, Surfynol CT121, Surfynol CT131, Surfynol CT136, Surfynol TG, Surfynol GA (all the above are trade names, manufactured by Air Product Chemicals Co., Ltd.), Olfine STG, Olfine SPC, Olfine E1004, Olfine E1010, and Olfine AK-02 (all the above are trade names, manufactured by Nisshin Chemical Industry Co., Ltd.).

Further, commercial products can be used as the acetylene alcohols represented by Formula (2) above. Specific examples thereof include Surfynol 61 (trade name, manufactured by Air Product Chemicals Co., Ltd.) and Olfine A, Olfine B, and Olfine P (all the above are trade names, manufactured by Nisshin Chemical Industry Co., Ltd.).

When the above-described penetrating agent is used, it may be employed as is or in a mixture with water. Furthermore, when a mixture is used which comprises a compound of at least one kind selected from ethers, acetates, carbitols and cellosolves and a compound of at least one kind selected from acetylene glycols and acetylene alcohols, the mixing ratio thereof may be appropriately determined according to operability in impregnating into the platen 15 or the type of the pigment ink that will be used. Furthermore, they may be used in mixture with water.

Moreover, it is preferred that a polyol of at least one kind which has a vapor pressure of 0.1 mm Hg or less at a temperature of 20° C. be contained in combination with the above-described penetrating agent. Additionally employing such a polyol makes it possible to prevent more efficiently the ink ejected onto the platen 15 from drying and to inhibit the precipitation of the pigment and fully absorb it with the platen 15 even when moisture evaporates from the pigment ink ejected onto the platen 15 and the pigment concentration in the ink increases, in particular, when the room temperature rises, for example, in a warm season.

The polyol preferably has a high moisture retaining capability and hygroscopicity and is not evaporated easily. Specific preferred examples include polyhydric alcohols such as glycerin, ethylene glycol, diethylene glycol, triethylene glycol, tetraethylene glycol, 1,3-propanediol, 1,3-butanediol, 1,4-butanediol, 2,3-butanediol, 1,5-pentanediol, 2-butene-1, 4-diol, 1,6-hexanediol, 2-methyl-2,4-plentanediol, 2-ethyl-1, 3-hexanediol, 1,2,6-hexanetriol, propylene glycol, dipropylene glycol, tripropylene glycol, and polyethylene glycol.

When the polyol is used in combination with the above-described penetrating agent, the mixing ratio thereof may be appropriately determined according to operability in impregnating into the platen 15 or the type of the pigment ink that will be used.

With the inkjet printer 10 using the pigment ink, the printing head 11 can be scanned along the guide shaft 12 by moving the carriage in the main scanning direction shown by arrow B along the guide shaft 12. At the same time, when the printing paper 13 is fed in the auxiliary scanning direction (arrow A), which is perpendicular to the scanning direction of the printing head 11, then printing on the printing paper 13 can be conducted by ejecting the ink via the nozzles 11A to 11D from the cartridges 17 and 18A to 18C.

The inkjet printing method employing the inkjet printer 10 using the pigment ink will be described hereinbelow based on FIG. 2 and FIG. 4.

When printing is conducted with the inkjet printer 10 using the pigment ink, as shown in FIG. 2(A), once the distal end 13A of the printing paper 13 which is transported in the auxiliary scanning direction shown by arrow A has reached a position below the printing head 11, the carriage moves reciprocally along the main scanning direction shown by arrow B, the pigment ink 14 is ejected from the printing head 11, and printing on the printing paper 13 is started. At this time, in order to conduct printing so that the margin at the front edge 13A of the printing paper 13 is zero, the pigment ink 14 is caused to overflow to the outside from the front edge 13A of the printing paper 13.

If a state shown in FIG. 2(B) is then assumed by transporting the printing paper 13 from the above-described position in the auxiliary scanning direction shown by arrow A, then in order to conduct printing so that the margin at the side edge 13B of the printing paper 13 is zero, the pigment ink 14 is caused to overflow to the outside from the side edge 13B of the printing paper 13 by appropriately adjusting the reciprocal movement distance of the carriage in the main scanning direction shown by arrow B.

Furthermore, if a state shown in FIG. 2(C) is then assumed by transporting the printing paper 13 from the above-described position in the auxiliary scanning direction shown by arrow A, then in order to conduct printing so that the margin at the rear edge 13C of the printing paper 13 is zero, the pigment ink 14 is caused to overflow to the outside from the rear edge 13C of the printing paper 13 (see FIG. 3).

Here, the pigment ink 14 that overflowed from the front edge 13A, side edge 13B, or rear edge 13C of the printing paper 13 is absorbed by the platen 15 shown in FIG. 3. The platen 15 can be impregnated with a compound of at least one kind selected from a group including the above-described ethers, acetates, cellosolves, carbitols, acetylene glycols, and acetylene alcohols as a penetrating agent and, if necessary, additionally with a polyol over the entire region from one end portion 15A to the other end portion 15B thereof.

As a result, as shown in FIG. 4, the pigment ink 14 that overflowed from the front edge 13A, side edge 13B, or rear edge 13C of the printing paper 13 can be efficiently absorbed by the platen 15. As a result, when the inkjet printer 10 using a pigment ink is employed under conditions such that the room temperature is increased, in particular, in a warm season, even if moisture evaporates from the pigment ink that was ejected onto a platen and the concentration of the pigment increases, the precipitation of the pigment can be inhibited and the pigment ink 14 can be fully absorbed by the platen 15.

Therefore, piling of the ink (pigment) on the surface of the platen 15, which was typical with the conventional technology, can be prevented. As a result, when printing is conducted on the printing paper 13, contamination of the end surface of the printing paper 13 due to contact of this end surface of the printing paper with the piled-up ink is prevented.

Further, a penetrating agent and, if necessary, also a polyol are impregnated into the platen 15 over the entire region from one end portion 15A to the other end portion 15B. Therefore, the ink that was absorbed by the platen 15 from the front edge 13A, side edge 13B, and rear edge 13C of the printing paper 13 can be caused to permeate over the entire region from one end portion 15A to the other end portion 15B of the platen 15. Therefore, the platen 15 can absorb a large quantity of pigment ink and the replacement cycle of the platen 15 can be extended.

Fifth Invention and Sixth Invention

An embodiment relating to the fifth invention and sixth invention will be described hereinbelow in greater detail based on the appended figures. The fifth invention and sixth invention are similar to the above-described first invention and second invention, except for the components which are different from those of the first invention and second invention. Therefore, features that were explained in relation to the above-described first invention and second invention can be appropriately employed with respect to those features of the fifth invention and sixth invention that are not described in detail.

The platen 15 of the embodiment relating to the fifth invention and sixth invention is impregnated with a solid humecant over the entire region from one end portion 15A to the other end portion 15B thereof. Preferably a compound of at least one kind selected from a group including alcohols, esters, nitrogen compounds, and sugars and having a melting point of 20° C. or higher and a solubility in water of 5 wt. % or higher at a temperature of 20° C. is used as the solid humecant. Such a solid humecant is present inside the platen 15 as a solid body at a temperature close to room temperature (about 20° C.) and is not evaporated. Such an agent is therefore preferred because the effect thereof can be maintained for a long time.

Alcohols, esters, nitrogen compounds, and sugars serving as a solid humecant may be impregnated individually or in a mixture of two or more thereof into the platen 15.

Examples of preferred alcohols as solid humecants include 1,4-butanediol, 2,3-butanediol, and 2-ethyl-2-(hydroxymethyl)-1,3-propanediol.

Specific examples of suitable esters include ethylene carbonate and the like.

Specific examples of nitrogen compounds include acetamide, N-methyl acetamide, 2-pyrrolidone, ϵ-caprolactam, urea, thiourea, and N-ethylurea.

Specific examples of sugars include dihydroxyacetone, erythritol, D-arabinose, L-arabinose, D-xylose, 2-deoxy-β-D-ribose, D-lyxose, L-lyxose, D-ribose, D-arabitol, ribitol, D-altrose, D-allose, D-galactose, L-galactose, D-quinovose, D-glucose, D-digitalose, D-digitoxose, D-cymarose, L-sorbose, D-tagatose, D-talose, 2-deoxy-D-glucose, D-fucose, L-fucose, D-fructose, D-mannose, L-rhamnose, D-inositol, myo-inositol, D-glucitol, D-mannitol, methyl=D-galactopyranoside, methyl=D-glucopyranoside, methyl=D-mannopyranoside, N-acetylchitobiose, isomaltose, xylobiose, gentiobiose, kojibiose, chondrosine, sucrose, cellobiose, sophorose, α,α-trehalose, maltose, melibiose, lactose, laminaribiose, rutinose, gentianose, stachyose, cellotriose, planteose, maltotriose, melezitose, lacto-N-tetraose, and raffinose.

The above-described solid humecants can be impregnated into the platen 15 upon heating to a temperature above the melting point and melting or in a mixture with water. Further, when two or more thereof are used, the mixing ratio thereof may be appropriately determined according to operability in impregnating into the platen 15 or the type of the pigment ink that will be used.

Moreover, it is preferred that a polyol of at least one kind which has a vapor pressure of 0.1 mm Hg or less at a temperature of 20° C. be contained in combination with the above-described solid humecant. Additionally employing such a polyol makes it possible to prevent more efficiently the ink ejected onto the platen 15 from drying and to inhibit the precipitation of the pigment and fully absorb it with the platen 15 even when moisture evaporates from the pigment ink ejected onto the platen 15 and the pigment concentration in the ink increases, in particular, when the room temperature rises, for example, in a warm season.

The polyol preferably has a high moisture retaining capability and hygroscopicity and is not evaporated easily. Specific preferred examples include polyhydric alcohols such as glycerin, ethylene glycol, diethylene glycol, triethylene glycol, tetraethylene glycol, 1,3-propanediol, 1,3-butanediol, 1,4-butanediol, 2,3-butanediol, 1,5-pentanediol, 2-butene-1, 4-diol, 1,6-hexanediol, 2-methyl-2,4-pentanediol, 2-ethyl-1, 3-hexanediol, 1,2,6-hexanetriol, propylene glycol, dipropylene glycol, tripropylene glycol, and polyethylene glycol.

When the polyol is used in combination with the above-described solid humecant, the mixing ratio thereof may be appropriately determined according to operability in impregnating into the platen 15 or the type of the pigment ink that will be used.

With the inkjet printer 10 using the pigment ink, the printing head 11 can be scanned along the guide shaft 12 by moving the carriage in the main scanning direction shown by arrow B along the guide shaft 12. At the same time, when the printing paper 13 is fed in the auxiliary scanning direction (arrow A), which is perpendicular to the scanning direction of the printing head 11, then printing on the printing paper 13 can be conducted by ejecting the ink via the nozzles 11A to 11B from the cartridges 17 and 18A to 18C.

The inkjet printing method employing the inkjet printer 10 using the pigment ink will be described hereinbelow based on FIG. 2 and FIG. 4.

When printing is conducted with the inkjet printer 10 using the pigment ink, as shown in FIG. 2(A), once the distal end 13A of the printing paper 13 which is transported in the auxiliary scanning direction shown by arrow A has reached a position below the printing head 11, the carriage moves reciprocally along the main scanning direction shown by arrow B, the pigment ink 14 is ejected from the printing head 11, and printing on the printing paper 13 is started. At this time, in order to conduct printing so that the margin at the front edge 13A of the printing paper 13 is zero, the pigment ink 14 is caused to overflow to the outside from the front edge 13A of the printing paper 13.

If a state shown in FIG. 2(B) is then assumed by transporting the printing paper 13 from the above-described position in the auxiliary scanning direction shown by arrow A, then in order to conduct printing so that the margin at the side edge 13B of the printing paper 13 is zero, the pigment ink 14 is caused to overflow to the outside from the side edge 13B of the printing paper 13 by appropriately adjusting the reciprocal movement distance of the carriage in the main scanning direction shown by arrow B.

Furthermore, if a state shown in FIG. 2(C) is then assumed by transporting the printing paper 13 from the above-described position in the auxiliary scanning direction shown by arrow A, then in order to conduct printing so that the margin at the rear edge 13C of the printing paper 13 is zero, the pigment ink 14 is caused to overflow to the outside from the rear edge 13C of the printing paper 13 (see FIG. 3).

Here, the pigment ink 14 that overflowed from the front edge 13A, side edge 13B, or rear edge 13C of the printing paper 13 is absorbed by the platen 15 shown in FIG. 3. The platen 15 can be impregnated with the above-described solid humecant and, if necessary, also with a polyol over the entire region from one end portion 15A to the other end portion 15B.

Therefore, as shown in FIG. 4, the pigment ink 14 that overflowed from the front edge 13A, side edge 13B, or rear edge 13C of the printing paper 13 can be efficiently absorbed by the platen 15. As a result, when the inkjet printer 10 using a pigment ink is employed under conditions such that the room temperature is increased, in particular, in a warm season, even if moisture evaporates from the pigment ink that was ejected onto a platen and the concentration of the pigment increases, the precipitation of the pigment can be inhibited and the pigment ink 14 can be fully absorbed by the platen 15.

Therefore, piling of the ink (pigment) on the surface of the platen 15, which was typical with the conventional technology, can be prevented. As a result, when printing is conducted on the printing paper 13, contamination of the end surface of the printing paper 13 due to contact of this end surface of the printing paper with the piled-up ink is prevented.

Further, a solid penetrating agent and, if necessary, also a polyol are impregnated into the platen 15 over the entire region from one end portion 15A to the other end portion 15B. Therefore, the ink that was absorbed by the platen 15 from the front edge 13A, side edge 13B, and rear edge 13C of the printing paper 13 can be caused to permeate over the entire region from one end portion 15A to the other end portion 15B of the platen 15. Therefore, the platen 15 can absorb a large quantity of pigment ink and the replacement cycle of the platen 15 can be extended.

Seventh Invention and Eighth Invention

An embodiment relating to the seventh invention and eighth invention will be described hereinbelow in greater detail based on the appended figures. The seventh invention and eighth invention are similar to the above-described first invention and second invention, except for the components which are different from those of the first invention and second invention. Therefore, features that were explained in relation to the above-described first invention and second invention can be appropriately employed with respect to those features of the seventh invention and eighth invention that are not described in detail.

The platen 15 of the embodiment relating to the seventh invention and eighth invention is impregnated with an oily solvent over the entire region from one end portion 15A to the other end portion 15B thereof. In particular when a resin employed in a pigment dispersion is used as the oily solvent, or when an oily solvent that can be dissolved or dispersed is used, it demonstrates good mutual solubility with the ink that fell on the platen and, even if the ink drying proceeds, the ink that will subsequently fall on the platen can be easily dissolved and absorbed.

The oily solvent preferably has a melting point of 10° C. or lower and a boiling point of 150° or higher. The preferred examples thereof include nonane (melting point −53° C., boiling point 150° C.), decane (melting point −30° C., boiling point 174° C.), dodecane (melting point −10° C., boiling point 216° C.), decaline (melting point −42° C., boiling point 195° C.), pentylbenzene (melting point −75° C., boiling point 205° C.), α-pinene (melting point −64° C., boiling point 156° C.), lamp oil (melting point 0° C. or below, boiling point 180-330° C.), light oil (melting point 0° C. or below, boiling point 170-340° C.), spindle oil, machine oil, Isopar G (trade name, manufactured by Exxon Petrochemicals Co., Ltd.) (melting point −57° C., boiling point 163-176° C.), Isopar H (melting point −63° C., boiling point 179-187° C.), Isopar L (melting point −57° C., boiling point 189-209° C.) (Isopar is a trade name of Exxon Co.), mesitylene (melting point −44° C., boiling point 164° C.), tetraline (melting point −35° C., boiling point 207° C.), cumene (melting point −96° C. or below, boiling point 152° C.), and other hydrocarbons, 3,5,5-trimethyl-1-hexanole (melting point −70° C. or below, boiling point 194° C.), 1-decanol (melting point 6° C., boiling point 232° C.), 1,3-propanediol (melting point −32° C., boiling point 214° C.), 1,3-butanediol (melting point −50° C. or below, boiling point 208° C.), 1,5-pentanediol (melting point −16° C., boiling point 242° C.), hexylene glycol (melting point −50° C. or below, boiling point 197° C.), octylene glycol (melting point −40° C., boiling point 243° C.), and other monools and polyols, cyclohexanone (melting point −45° C., boiling point 156° C.), benzyl acetate (melting point −52° C., boiling point 214° C.), 2-(benzyloxy) ethanol (melting point −25° C. or below, boiling point 256° C.), dipropylene glycol monomethyl ether (melting point −80° C., boiling point 190° C.), and thiodiethanol (melting point −10° C., boiling point 282° C.). If the melting point is 10° C. or less, then the solvent is in a liquid state at working temperature of the inkjet printer and the ink that fell onto the platen rapidly flows to the side opposite the impact surface. Furthermore, if the boiling temperature is 150° C. or higher, the solvent is comparatively difficult to dissolve and it can maintain its effect for a long time.

Those oily solvents may be impregnated into the platen 15 individually or in a mixture of two or more thereof.

With such inkjet printer 10, the printing head 11 can be scanned along the guide shaft 12 by moving the carriage in the main scanning direction shown by arrow B along the guide shaft 12. At the same time, when the printing paper 13 is fed in the auxiliary scanning direction (arrow A), which is perpendicular to the scanning direction of the printing head 11, then printing on the printing paper 13 can be conducted by ejecting the ink via the nozzles 11A to 11B from the cartridges 17 and 18A to 18C.

The inkjet printing method employing the inkjet printer 10 using the pigment ink will be described hereinbelow based on FIG. 2 and FIG. 4.

When printing is conducted with the inkjet printer 10 using the pigment ink, as shown in FIG. 2(A), once the distal end 13A of the printing paper 13 which is transported in the auxiliary scanning direction shown by arrow A has reached a position below the printing head 11, the carriage moves reciprocally along the main scanning direction shown by arrow B, the pigment ink 14 is ejected from the printing head 11, and printing on the printing paper 13 is started. At this time, in order to conduct printing so that the margin at the front edge 13A of the printing paper 13 is zero, the pigment ink 14 is caused to overflow to the outside from the front edge 13A of the printing paper 13.

If a state shown in FIG. 2(B) is then assumed by transporting the printing paper 13 from the above-described position in the auxiliary scanning direction shown by arrow A, then in order to conduct printing so that the margin at the side edge 13B of the printing paper 13 is zero, the pigment ink 14 is caused to overflow to the outside from the side edge 13B of the printing paper 13 by appropriately adjusting the reciprocal movement distance of the carriage in the main scanning direction shown by arrow B.

Furthermore, if a state shown in FIG. 2(C) is then assumed by transporting the printing paper 13 from the above-described position in the auxiliary scanning direction shown by arrow A, then in order to conduct printing so that the margin at the rear edge 13C of the printing paper 13 is zero, the pigment ink 14 is caused to overflow to the outside from the rear edge 13C of the printing paper 13 (see FIG. 3).

Here, the pigment ink 14 that overflowed from the front edge 13A, side edge 13B, or rear edge 13C of the printing paper 13 is absorbed by the platen 15 shown in FIG. 3. The platen 15 is impregnated with the above-described oily solvent over the entire region from one end portion 15A to the other end portion 15B.

Therefore, as shown in FIG. 4, the pigment ink 14 that overflowed from the front edge 13A, side edge 13B, or rear edge 13C of the printing paper 13 can be efficiently absorbed by the platen 15. As a result, when the inkjet printer 10 using the ink is employed under conditions such that the room temperature is increased, in particular, in a warm season, the ink can be rapidly absorbed into the absorbing agent before the drying thereof reached the advanced stage and the ink became viscous. Furthermore, the solvent shows substantially no evaporation in the utilization environment of the printer, Therefore, even if printing is conduced intermittently in the environment with increased room temperature, in particular, in a warm season, precipitation of the colorants can be inhibited and the ink can be fully absorbed by the platen. Therefore, piling of the dried ink on the surface of the platen can be prevented. As a result, the printing medium that is employed thereafter is prevented from being brought into contact with the piled-up ink and contamination of the printing medium can be prevented.

EXAMPLES

Examples will be described below. An urethane foam was used for the platen 15 in the working and comparative examples. A urethane foam used in Examples 1 to 8 was impregnated with the components used in the first invention, a urethane foam used in Examples 9 to 18 was impregnated with the components used in the third invention, a urethane foam used in Examples 19 to 32 was impregnated with the components used in the fifth invention, and a urethane foam used in Examples 33 to 40 was impregnated with the components used in the seventh invention.

An unimpregnated urethane foam was used in Comparative Examples 1, 3, and 4, and a urethane foam impregnated with pure water was used in Comparative Example 2.

An ink using a pigment dispersed in anionic water-soluble resin was used as the pigment ink employed in the Examples 1 to 32 and Comparative Examples 1 and 2. More specifically the following inks were used.

A black pigment ink comprised carbon black, 6 wt. %, Joncryl 678 (trade name, manufactured by Johnson Polymer Co., Ltd.), 3 wt. %, as an anionic water-soluble resin, glycerin, 15 wt. %, triethylene glycol monobutyl ether 5 wt. %, Olfine E1010 (trade name, acetylene glycol surfactant, manufactured by Nisshin Chemical Industry Co., Ltd.), 1 wt. %, triethanolamine, 1 wt. %, and pure water as the balance up to 100 wt. %.

A magenta pigment ink comprised C. I. Pigment Red 122, 5 wt. %, Joncryl 678 (trade name, manufactured by Johnson Polymer Co., Ltd.), 2 wt. %, as an anionic water-soluble resin, glycerin, 15 wt. %, triethylene glycol monobutyl ether 5 wt. %, Olfine E1010 (trade name, acetylene glycol surfactant, manufactured by Nisshin Chemical Industry Co., Ltd.), 1 wt. %, triethanolamine, 1 wt. %, and pure water as the balance up to 100 wt. %.

A cyan pigment ink comprised C. I. Pigment Blue 15:3, 5 wt. %, Joncryl 678 (trade name, manufactured by Johnson Polymer Co., Ltd.), 4 wt. %, as an anionic water-soluble resin, glycerin, 15 wt. %, triethylene glycol monobutyl ether, 5 wt. %, Olfine E1010 (trade name, acetylene glycol surfactant, manufactured by Nisshin Chemical Industry Co., Ltd.), 1 wt. %, triethanolamine, 1 wt. %, and pure water as the balance up to 100 wt. %.

A yellow pigment ink comprised C. I. Pigment Yellow 74, 5 wt. %, Joncryl 678 (trade name, manufactured by Johnson Polymer Co., Ltd.), 2 wt. %, as an anionic water-soluble resin, glycerin, 15 wt. %, triethylene glycol monobutyl ether, 5 wt. %, Olfine E1010 (trade name, acetylene glycol surfactant, manufactured by Nisshin Chemical Industry Co., Ltd.), 1 wt. %, triethanolamine, 1 wt. %, and pure water as the balance up to 100 wt. %.

An ink using a pigment dispersed in anionic water-soluble resin was used as the pigment ink employed in the Examples 33 to 36 and Comparative Example 3. More specifically the following inks were used.

A black pigment ink comprised carbon black. 6 wt. %, Joncryl 611 (trade name, manufactured by Johnson Polymer Co., Ltd.), 3 wt. % as an anionic water-soluble resin, glycerin, 15 wt. %, triethylene glycol monobutyl ether 5 wt. %, Olfine E1010 (trade name, acetylene glycol surfactant, manufactured by Nisshin Chemical Industry Co., Ltd.), 1 wt. %, potassium hydroxide, 0.15 wt. %, and pure water as the balance up to 100 wt. %.

A cyan pigment ink was prepared in the same manner as the above-described black pigment ink, except that C. I. Pigment Blue 15:4, 4 wt. %, and Joncryl 611 (trade name, manufactured by Johnson Polymer Co., Ltd.), 4 wt. %, as an anionic water-soluble resin, were used.

A magenta pigment ink was prepared in the same manner as the above-described black pigment ink, except that C. I. Pigment Red 122, 5 wt. %, and Joncryl 611 (trade name, manufactured by Johnson Polymer Co., Ltd.), 1.5 wt. %, as an anionic water-soluble resin, were used.

A yellow pigment ink was prepared in the same manner as the above-described black pigment ink, except that C. I. Pigment Yellow 74, 6 wt. %, Joncryl 611 (trade name, manufactured by Johnson Polymer Co., Ltd.), 2 wt. %, as an anionic water-soluble resin, were used.

An ink using a pigment dispersed in oil-soluble resin was used as the pigment ink employed in the Examples 37 to 40 and Comparative Example 4. More specifically the following inks were used.

A dispersed ink comprising carbon black, 10 wt. %, maleinated rosin, 16 wt. %, as an oil-soluble resin, ethylcyclohexane, 38 wt. %, methylcyclohexane, 35.5 wt. %, and polyethylene wax, 0.5 wt. %, was used as the black pigment ink.

A cyan pigment ink was prepared in the same manner as the above-described black pigment ink, except that C. I. Pigment Blue 15:4, 6 wt. %, and maleinated rosin, 20 wt. %, as an oil-soluble resin, were used.

A magenta pigment ink was prepared in the same manner as the above-described black pigment ink, except that C. I. Pigment Red 122, 7 wt. %, and maleinated rosin, 19 wt. %, as an oil-soluble resin, were used.

A yellow pigment ink was prepared in the same manner as the above-described black pigment ink, except that C. I. Pigment Yellow 74, 7 wt. %, and maleinated rosin, 19 wt. %, as an oil-soluble resin, were used.

Then, the black ink cartridge 17 was filled with the black ink, the cyan cartridge 18A was filled with the cyan ink, the magenta cartridge 18B was filled with the magenta ink, and the yellow cartridge 18C was filled with yellow ink.

Example 1

A liquid mixture of triethylene glycol, 99 wt. %, as a humecant, and diethanolamine, 1 wt. %, as a base was used and the liquid mixture was uniformly applied to a urethane foam at 200 g/m$^2$. The urethane foam was installed in an inkjet printer EM-930C (trade name, manufactured by Seiko Epson Co.) so that the gap with the passing paper was 2 mm. Then 230 mm×297 mm image data was fed to a printing medium of A4 size (210 mm×297 mm) and edgeless printing was conducted with a number of passes of 1,000,000 in a 40° C./20% RH environment.

Example 2

A liquid mixture of tetraethylene glycol, 79.9 wt. %, as a humecant, sodium hydroxide, 0.1 wt. %, as a base, and water, 20 wt. % was used. Impregnation of a urethane foam, installation in the inkjet printer, and printing were carried out in the same manner as in Example 1.

Example 3

Triethanolamine was used as a humecant and a base. Impregnation of a urethane foam, installation in the inkjet printer, and printing were carried out in the same manner as in Example 1.

Example 4

A liquid mixture of 1,2,6-hexanetriol, 99 wt. %, as a humecant and N-methyl imidazole, 1 wt. %, as a base was used. Impregnation of a urethane foam, installation in the inkjet printer, and printing were carried out in the same manner as in Example 1.

Example 5

A liquid mixture of Mabit (trade name, manufactured by Hayashibara Co., Ltd.) comprising maltitol, 49.8 wt. %, as a humecant, lithium hydroxide 0.1 wt. %, as a base, Denicide BIT (trade name, manufactured by Nagase Chemtex Co., Ltd.), 0.1 wt. % containing benzoisothiazolone as a preservative, and water, 50 wt. %, was used. Impregnation of a urethane foam, installation in the inkjet printer, and printing were carried out in the same manner as in Example 1.

Example 6

A liquid mixture of glycerin, 98.7 wt. %, as a humecant, triethanolamine, 1 wt. %, as a base, and Proxel XL2 (trade name, manufactured by Avecia Kabushiki Kaisha), 0.3 wt. % containing 1,2-benzothiazolin-3-one as a preservative, was used. Impregnation of a urethane foam, installation in the inkjet printer, and printing were carried out in the same manner as in Example 1.

Example 7

A liquid mixture of polyethylene glycol #400, 79.4 wt. %, as a humecant, tripropanolamine, 0.5 wt. %, as a base, Proxel GXL (trade name, manufactured by Avecia Kabushiki Kaisha), 0.1 wt. % containing 1,2-benzothiazolin-3-one as a preservative, and water, 20 wt. %, was used. Impregnation of a urethane foam, installation in the inkjet printer, and printing were carried out in the same manner as in Example 1.

Example 8

A liquid mixture of polyethylene glycol #200, 79.8 wt. %, as a humecant, sodium hydroxide, 0.1 wt. %, as a base, Denicide CSA (trade name, manufactured by Nagase Chemtex Co., Ltd.), 0.1 wt. % containing 4,4-dimethyloxazolidine as a preservative, and water, 20 wt. %, was used. Impregnation of a urethane foam, installation in the inkjet printer, and printing were carried out in the same manner as in Example 1.

Example 9

A liquid mixture comprising triethylene glycol monobutyl ether, which is an ether, 10 wt. %, as a penetrating agent and pure water as the balance was used. Impregnation of a urethane foam, installation in the inkjet printer, and printing were carried out in the same manner as in Example 1.

Example 10

A liquid mixture comprising ethylene glycol diethyl ether, which is a cellosolve, 5 wt. %, as a penetrating agent and pure water as the balance was used. Impregnation of a urethane foam, installation in the inkjet printer, and printing were carried out in the same manner as in Example 1.

Example 11

Diethylene glycol monobutyl ether, which is a carbitol, was used as a penetrating agent. Impregnation of a urethane foam, installation in the inkjet printer, and printing were carried out in the same manner as in Example 1.

Example 12

A liquid mixture comprising Surfynol 465 (trade name, manufactured by Air Product Chemicals Co., Ltd.), which is an acetylene glycol, 20 wt. %, as a penetrating agent and pure water as the balance was used. Impregnation of a urethane foam, installation in the inkjet printer, and printing were carried out in the same manner as in Example 1.

Example 13

A liquid mixture comprising Olfine B (trade name, manufactured by Nisshin Chemical Industry Co., Ltd.), which is an acetylene alcohol, 10 wt. %, as a penetrating agent and pure water as the balance was used. Impregnation of a urethane foam, installation in the inkjet printer, and printing were carried out in the same manner as in Example 1.

Example 14

A liquid mixture comprising, as a penetrating agent, diethylene glycol monobutyl ether, which is a carbitol, 50 wt. %. Olfine E1010 (trade name, manufactured by Nisshin Chemical Industry Co., Ltd.), which is an acetylene glycol, 10 wt. %, and pure water as the balance was used. Impregnation of a urethane foam, installation in the inkjet printer, and printing were carried out in the same manner as in Example 1.

Example 15

A liquid mixture comprising, as a penetrating agent, triethylene glycol monobutyl ether, which is an ether, 60 wt. %, Surfynol 104 (trade name, manufactured by Air Product Chemicals Co., Ltd.), which is an acetylene glycol, 1 wt. %, and pure water as the balance was used. Impregnation of a urethane foam, installation in the inkjet printer, and printing were carried out in the same manner as in Example 1.

Example 16

A liquid mixture comprising, as a penetrating agent, ethylene glycol dibutyl ether, which is a cellosolve, 90 wt. %, and Surfynol 61 (trade name, manufactured by Air Product Chemicals Co., Ltd.), which is an acetylene alcohol, 10 wt. %, was used. Impregnation of a urethane foam, installation in the inkjet printer, and printing were carried out in the same manner as in Example 1.

Example 17

A liquid mixture comprising, as a penetrating agent, Surfynol 465 (trade name, manufactured by Air Product Chemicals Co., Ltd.), which is an acetylene glycol, 10 wt. %, glycerin, which is a polyol, 20 wt. %, and pure water as the balance was used. Impregnation of a urethane foam, installation in the inkjet printer, and printing were carried out in the same manner as in Example 1.

Example 18

A liquid mixture comprising, as a penetrating agent, ethylene glycol dibutyl ether, which is a cellosolve, 40 wt. %, Surfynol 61 (trade name, manufactured by Air Product Chemicals Co., Ltd.), which is an acetylene alcohol, 10 wt. %, glycerin, which is a polyol, 10 wt. %, and pure water as the balance was used. Impregnation of a urethane foam, installation in the inkjet printer, and printing were carried out in the same manner as in Example 1.

Example 19

A liquid mixture comprising 2-ethyl-2-(hydroxymethyl)-1,3-propanediol, which is an alcohol, 50%, as a solid humecant and pure water as the balance was used. Impregnation of a urethane foam, installation in the inkjet printer, and printing were carried out in the same manner as in Example 1.

Example 20

A liquid mixture comprising ethylene carbonate, which is an ester, 10%, as a solid humecant and pure water as the balance was used. Impregnation of a urethane foam, installation in the inkjet printer, and printing were carried out in the same manner as in Example 1.

Example 21

2-Pyrrolidone, which is a nitrogen compound, was heated to a temperature above the melting point and used in a molten state as a solid humecant. Impregnation of a urethane foam, installation in the inkjet printer, and printing were carried out in the same manner as in Example 1.

Example 22

A liquid mixture comprising urea, which is a nitrogen compound, 20%, as a solid humecant and pure water as the balance was used. Impregnation of a urethane foam, installation in the inkjet printer, and printing were carried out in the same manner as in Example 1.

Example 23

A liquid mixture comprising D-mannose, which is a sugar, 15%, as a solid humecant and pure water as the balance was used. Impregnation of a urethane foam, installation in the inkjet printer, and printing were carried out in the same manner as in Example 1.

Example 24

A liquid mixture comprising sucrose, which is a sugar, 20%, as a solid humecant and pure water as the balance was used. Impregnation of a urethane foam, installation in the inkjet printer, and printing were carried out in the same manner as in Example 1.

Example 25

A liquid mixture comprising maltose, which is a sugar, 5%, as a solid humecant and pure water as the balance was used. Impregnation of a urethane foam, installation in the inkjet printer, and printing were carried out in the same manner as in Example 1.

Example 26

A liquid mixture comprising lactose, which is a sugar, 15%, as a solid humecant and pure water as the balance was used. Impregnation of a urethane foam, installation in the inkjet printer, and printing were carried out in the same manner as in Example 1.

Example 27

A liquid mixture comprising 2-ethyl-2-(hydroxymethyl)-1,3-propanediol, which is an alcohol, 10%, and 2-pyrrolidone, which is a nitrogen compound, 10 wt. %, as a solid humecant and pure water as the balance was used. Impregnation of a urethane foam, installation in the inkjet printer, and printing were carried out in the same manner as in Example 1.

Example 28

A liquid mixture comprising urea, which is a nitrogen compound, 20%, and sucrose, which is a nitrogen compound, 10 wt. %, as a solid humecant and pure water as the balance was used. Impregnation of a urethane foam, installation in the inkjet printer, and printing were carried out in the same manner as in Example 1.

Example 29

A liquid mixture comprising 2-ethyl-2-(hydroxymethyl)-1,3-propanediol, which is an alcohol, 10%, and D-mannose, which is a sugar, 5 wt. %, as a solid humecant and pure water as the balance was used. Impregnation of a urethane foam, installation in the inkjet printer, and printing were carried out in the same manner as in Example 1.

Example 30

A liquid mixture comprising 2-ethyl-2-(hydroxymethyl)-1,3-propanediol, which is an alcohol, 10%, ethylene carbonate, which is an ester, 10 wt. %, ϵ-caprolactam, which is a nitrogen compound, 10 wt. %, and maltose, which is a sugar, 10 wt. %, as a solid humecant and pure water as the balance was used. Impregnation of a urethane foam, installation in the inkjet printer, and printing were carried out in the same manner as in Example 1.

Example 31

A liquid mixture comprising 2-ethyl-2-(hydroxymethyl)-1,3-propanediol, which is an alcohol, 30%, glycerin which is a polyol, 30 wt. %, as a solid humecant and pure water as the balance was used. Impregnation of a urethane foam, installation in the inkjet printer, and printing were carried out in the same manner as in Example 1.

Example 32

A liquid mixture comprising 2-ethyl-2-(hydroxymethyl)-1,3-propanediol, which is an alcohol, 10%, ethylene carbonate, which is an ester, 10 wt. %, ϵ-caprolactam, which is a nitrogen compound, 10 wt. %, maltose, which is a sugar, 10 wt. %, and 2-methyl-2,4-pentanediol, which is a polyol, 10 wt. %, as a solid humecant and pure water as the balance was used. Impregnation of a urethane foam, installation in the inkjet printer, and printing were carried out in the same manner as in Example 1.

Example 33

3,5,5-Trimethyl-1-hexanol (melting point −70° C. or below, boiling point 194° C.) was used as an oily solvent.

Impregnation of a urethane foam, installation in the inkjet printer, and printing were carried out in the same manner as in Example 1.

Example 34

2-(Benzyloxy)ethanol (melting point −25° C. or below, boiling point 256° C.) was used as an oily solvent. Impregnation of a urethane foam, installation in the inkjet printer, and printing were carried out in the same manner as in Example 1.

Example 35

Isopar H (melting point −63° C. or below, boiling point 216° C.) was used as an oily solvent. Impregnation of a urethane foam, installation in the inkjet printer, and printing were carried out in the same manner as in Example 1.

Example 36

1-Decanol (melting point 6° C., boiling point 232° C.), 50 wt. %, and decane (melting point −30° C. or below, boiling point 174° C.), 50 wt. %, were used as an oily solvent. Impregnation of a urethane foam, installation in the inkjet printer, and printing were carried out in the same manner as in Example 1.

Example 37

Dodecane (melting point −10° C., boiling point 216° C.) was used as an oily solvent. Impregnation of a urethane foam, installation in the inkjet printer, and printing were carried out in the same manner as in Example 1.

Example 38

Pentylbenzene (melting point −75° C., boiling point 205° C.) was used as an oily solvent. Impregnation of a urethane foam, installation in the inkjet printer, and printing were carried out in the same manner as in Example 1.

Example 39

Octylene glycol (melting point −40° C., boiling point 243° C.) was used as an oily solvent. Impregnation of a urethane foam, installation in the inkjet printer, and printing were carried out in the same manner as in Example 1.

Example 40

1-Decanol (melting point 6° C., boiling point 232° C.), 50 wt. %, and decaline (melting point 42° C., boiling point 195° C.), 50 wt. %, were used as an oily solvent. Impregnation of a urethane foam, installation in the inkjet printer, and printing were carried out in the same manner as in Example 1.

Evaluation

After printing has been carried out in the above-described manner, the urethane foam installed in the inkjet printer and the printed matter were observed and evaluated in the manner as follows.

Examples 1 to 8

In Examples 1 to 8, no ink (pigment) piling occurred on the urethane foam and contamination of the printed matter could be prevented.

This result led to a conclusion that impregnating the platen 15 with the components referred to in the first invention and second invention is efficient for preventing the occurrence of ink (pigment) piling.

Furthermore, Examples 6 to 8 demonstrated a remarkable effect that no ink (pigment) piling has occurred and the printing matter could be prevented from contamination even when the number of edgeless printing cycles was extended to 1,500,000.

This result led to a conclusion that the effect of preventing the occurrence of ink (pigment) piling can be enhanced by impregnating the platen 15 with a polyol with a vapor pressure of 0.01 mm Hg or less at a temperature of 20° C. as a humecant, an alkanolamine, which is a base, or an inorganic base, and a preservative, as referred to in the present invention.

Examples 9 to 18

In Examples 9 to 18, too, no ink (pigment) piling occurred on the urethane foam and contamination of the printed matter could be prevented.

This result led to a conclusion that impregnating the platen 15 with the penetrating agent as referred to in the third invention and fourth invention is efficient for preventing the occurrence of ink (pigment) piling.

Furthermore, Examples 14 to 18 demonstrated a remarkable effect that no ink (pigment) piling has occurred and the printing matter could be prevented from contamination even when the number of edgeless printing cycles was extended to 1,500,000.

This result led to a conclusion that the effect of preventing the occurrence of ink (pigment) piling can be enhanced by impregnating the platen 15 with a composition comprising a compound of at least of one kind selected from the group including ethers, acetates, cellosolves, and carbitols, and at least of one kind selected from the group including acetylene glycols and acetylene alcohols, as a penetrating agent as referred to in the present invention, or with a composition combining the penetrating agent as referred to in the present invention with a polyol.

Examples 19 to 32

In Examples 19 to 32, too, no ink (pigment) piling occurred on the urethane foam and contamination of the printed matter could be prevented.

This result led to a conclusion that impregnating the platen 15 with the solid humecant as referred to in the fifth invention and sixth invention is efficient for preventing the occurrence of ink (pigment) piling.

Furthermore, Examples 31 and 32 demonstrated a remarkable effect that no ink (pigment) piling has occurred and the printing matter could be prevented from contamination even when the number of edgeless printing cycles was extended to 1,500,000.

This result led to a conclusion that the effect of preventing the occurrence of ink (pigment) piling can be enhanced by impregnating the platen 15 with a composition comprising a solid humecant as referred to in the present invention and a polyol with a vapor pressure of 0.1 mm Hg or less at a temperature of 20° C.

Examples 33 to 40

With respect to Examples 33 to 40, continuous printing on 2000 sheets was conducted under conditions identical to those of Example 1 and evaluation was then conducted based on the following criteria.

AA: no deposition of ink on the urethane foam was observed, or ink deposition was 1 mm or less.

A: deposition of ink on the urethane foam was observed, but it was more than 1 mm, but less than 2 mm, and did not reach the back surface of the paper.

B: ink that deposited on the urethane foam reached the back surface of the paper and the ink was retransferred to the back surface of the paper.

The evaluation results together with the oily solvents used are shown in Table 1.

TABLE 1

| | Oily solvent | Ink piling |
|---|---|---|
| Example 33 | 3,5,6-Trimethyl-1-hexanol | AA |
| Example 34 | 2-(Benzyloxy)ethanol | AA |
| Example 35 | Isopar H | A |
| Example 36 | 1-Decanol, decane | A |
| Example 37 | 3,5,5-Trimethyl-1-hexanol | A |
| Example 38 | 2-(Benzyloxy)ethanol | A |
| Example 39 | Isopar H | AA |
| Example 40 | 1-Decanol, decane | AA |
| Comparative Example 3 | No impregnation | B |
| Comparative Example 4 | No impregnation | B |

As shown by the edgeless printing results presented in Table 1, by contrast with Comparative Examples 3, 4, in Examples 33 to 40, no ink deposited after continuous printing under high-temperature and dry conditions, or a very small deposition of ink was observed and the rear surface of the printing medium could be prevented from contamination.

In particular, in was established that an extremely small deposition of ink or no deposition of ink was observed in Examples 33, 34, 39, 40 and the combination with an oily solvent that had mutual solubility with the ink used was especially advantageous.

Comparative Examples 1 to 4

On the other hand, in Comparative Examples 1 and 2, deposition of ink (pigment) was observed and the back surface of the printed matter was contaminated. In Comparative Examples 3 and 4, too, deposition of ink (pigment) was observed and the ink was retransferred to the back surface of the printed matter, as shown in Table 1.

As described hereinabove, with the first invention and second invention, the platen is impregnated with a humecant and a base. Therefore, the platen can be converted into a substance that can easier absorb the pigment ink. As a result, pigment precipitation can be inhibited and it can be absorbed with sufficient efficiency by the platen even if moisture has evaporated from the pigment ink ejected onto the platen and the concentration of the pigment in the ink has increased when the room temperature rose, for example, in a warm season.

Therefore, the ink (pigment) is prevented from piling on the platen surface, which was typical with the conventional technology. As a result, when the printing is conducted on the next printing medium, the end surface of the printing medium can be prevented from being brought into contact with the piled-up ink, and the end surface of the printing medium can be prevented from contamination.

Further, with the third invention and fourth invention, the platen is impregnated with a penetrating agent and, if necessary, with a polyol which has a vapor pressure of 0.1 mm Hg or less at a temperature of 20° C. Therefore, the platen can be converted into a substance that absorbs the pigment ink even easier. As a result, pigment precipitation can be inhibited and it can be absorbed with sufficient efficiency by the platen even if moisture has evaporated from the pigment ink ejected onto the platen and the concentration of the pigment in the ink has increased when the room temperature rose, for example, in a warm season.

Therefore, the ink (pigment) is prevented from piling on the platen surface, which was typical with the conventional technology. As a result, when the printing is conducted on the next printing medium, the end surface of the printing medium can be prevented from being brought into contact with the piled-up ink, and the end surface of the printing medium can be prevented from contamination.

Further, with the fifth invention and sixth invention, the platen is impregnated with a solid humecant. Therefore, pigment precipitation can be inhibited and it can be absorbed with sufficient efficiency by the platen even if moisture has evaporated from the pigment ink ejected onto the platen and the concentration of the pigment in the ink has increased when the room temperature rose, for example, in a warm season.

Therefore, the ink (pigment) is prevented from piling on the platen surface, which was typical with the conventional technology. As a result, when the printing is conducted on the next printing medium, the end surface of the printing medium can be prevented from being brought into contact with the piled-up ink, and the end surface of the printing medium can be prevented from contamination.

Further, with the seventh invention and eighth invention, the platen is impregnated with an oily solvent. As a result, the ink that was printed on the outside of the edges of the printing medium can be rapidly absorbed inside the platen before the drying thereof reached the advanced stage and the ink became viscous. Further, if a compound with a melting point of 10° C. or more and a boiling point of 150° C. or more is selected, the ink shows substantially no evaporation even in the utilization environment of the inkjet printer, and even if printing is conduced intermittently under the environment with increased room temperature, in particular, in a warm season, precipitation of the colorants can be inhibited and they can be fully absorbed by the platen.

As a result, piling of the dried ink on the surface of the platen can be prevented. Therefore, the printing medium that is employed thereafter is prevented from being brought into contact with the piled-up ink and contamination of the printing medium can be prevented.

The invention claimed is:

1. An inkjet printer comprising a platen, which absorbs a pigment ink that overflows to the outside of a printing medium when edgeless printing is carried out on the printing medium by using an ink that employs a pigment as a colorant, moving a printing head along a guide shaft, and ejecting the pigment ink from the printing head, wherein said platen comprises a penetrating agent that comprises a compound of at least one kind selected from the group consisting of ethers, acetates, cellosolves, carbitols, acetylene glycols, and acetylene alcohols, and wherein said platen further comprises a polyol with a vapor pressure of 0.1 mm Hg or less at a temperature of 20° C.

2. The inkjet printer according to claim 1, wherein said penetrating agent comprises a compound of at least one kind selected from the group consisting of ethers, acetates, cellosolves, and carbitols and a compound of at least one kind selected from the group consisting of acetylene glycols and acetylene alcohols.

3. The inkjet printer according to claim 2, comprising a plurality of inks, wherein each of the plurality of inks is a pigment ink.

4. The inkjet printer according to claim 1, comprising a plurality of inks, wherein each of the plurality of inks is a pigment ink.

5. An inkjet printing method comprising a step of causing a platen to absorb a pigment ink that overflows to the outside of a printing medium when edgeless printing is carried out on the printing medium by using an ink that employs a pigment as a colorant, moving a printing head along a guide shaft, and ejecting the pigment ink from the printing head, wherein said platen is impregnated with a penetrating agent comprising a compound of at least one kind selected from the group consisting of ethers, acetates, cellosolves, carbitols, acetylene glycols, and acetylene alcohols, and wherein said platen is further impregnated with a polyol with a vapor pressure of 0.1 mm Hg or less at a temperature of 20° C.

6. The inkjet printing method according to claim 5, wherein the penetrating agent comprises a compound of at least one kind selected from the group consisting of ethers, acetates, cellosolves, and carbitols and a compound of at least one kind selected from the group consisting of acetylene glycols and acetylene alcohols.

7. The inkjet printing method according to claim 6, comprising depositing a plurality of inks onto the printing medium, wherein each of the plurality of inks is a pigment ink.

8. The inkjet printing method according to claim 5, comprising depositing a plurality of inks onto the printing medium, wherein each of the plurality of inks is a pigment ink.

* * * * *